US005154689A

United States Patent [19]

Modoux et al.

[11] Patent Number: 5,154,689

[45] Date of Patent: Oct. 13, 1992

[54] BLANK FORMING MACHINE WITH A FRONT WASTE REMOVAL DEVICE

[75] Inventors: Joseph Modoux, Echallens; Mauro Chiari, Lausanne, both of Switzerland

[73] Assignee: Bobst SA, Switzerland

[21] Appl. No.: 682,468

[22] Filed: Apr. 9, 1991

[30] Foreign Application Priority Data

Apr. 9, 1990 [CH] Switzerland ..... 01197/90

[51] Int. Cl.[5] ..... B31B 1/20

[52] U.S. Cl. ..... 493/342; 493/83; 83/103; 83/155.1

[58] Field of Search ..... 493/82, 83, 342; 83/103, 107, 151-154, 155.1

[56] References Cited

U.S. PATENT DOCUMENTS 4,026,199 5/1977 Adams et al. ..... 493/342
4,175,477 11/1979 Inose et al. ..... 93/36
4,371,369 2/1983 Wright, III ..... 493/83
4,485,708 12/1984 Halff et al. ..... 83/277
4,612,006 9/1986 Tokuno et al. ..... 493/342
4,767,393 8/1988 Smith ..... 493/342

FOREIGN PATENT DOCUMENTS 324448 11/1957 Switzerland .

*Primary Examiner*—Bruce M. Kisliuk
*Assistant Examiner*—Jack Lavinder
*Attorney, Agent, or Firm*—Hill, Van Santen, Steadman & Simpson

[57] ABSTRACT

A machine, which is designed for converting sheets into blanks for forming packages, has at least an infeed station, a processing station for cuting and creasing the sheets of material into blanks, which processing station includes an upper and lower platen and a chain transfer conveyor for moving the sheets between the platens and any additional stations, such as waste stripping stations and delivery stations. To remove a front waste held in the gripper bars of the transfer conveyor after the blanks have been separated from the sheets, the machine includes a front waste removal station positioned above the upper platen of the processing station.

10 Claims, 4 Drawing Sheets

BLANK FORMING MACHINE WITH A FRONT WASTE REMOVAL DEVICE

BACKGROUND OF THE INVENTION

The present invention is directed to a machine constructed to process plates or sheet workpieces into blanks for being converted into a package. The machine includes an infeed station, at least a press station for cutting, creasing or embossing, which press station includes an upper fixed beam or platen, a lower movable beam or platen and means for moving the lower movable beam or platen toward and away from the upper beam, a conveyor, which is formed by a pair of close-looped chain provided with gripper bars, is arranged to carry the sheet from one processing station to another and between the two platens and an arrangement or means for removing the front waste from the sheet, which is situated on an upper return track of the chain pairs.

In the prior art there exists a machine for processing which has an upper beam for processing or cutting a sheet into a blank, an arrangement for removing the waste of the blank, followed by means for removing the front waste from the gripper bars. As illustrated in FIG. 1, which is taken on the operator's side of the machine, the machine has an infeed station I, in which is located a pile Pe of sheets F; a cutting, creasing and/or embossing station P in which the lowermost sheet F of the pile Pe is carried between an upper fixed beam or platen Ss and a lower, movable beam or platen Si of the press; a stripper station E in which the offale De, which is cut out of the sheet F by the cutting device fitted on a tool O itself held on the upper beam Ss of the press P, are separated from the sheet F and ejected downward into a waste collector D; a delivery station R in which the blanked sheets are assembled on a conveyor system T to build up in a pile Ps, which, when completed, is carried out of the machine.

In the course of the operation of the above-described machine, the sheets F are carried individually from one station to another by means of a gripper bar system B, which is moved by a pair of chains C which form a closed-loop circuit having a lower run passing between the platens Ss and Si, through the stripper station E, the delivery station R and then a return upper run. To this aim, the lengthwise ends of the machine are foreseen to be equipped with two return devices Rm and Ra, with the device Rm illustrated as being a pulley or roller for the chain pair C. The first return device Rm is situated on the entrance between the infeed station I and the press P with regard to the lower run so that the lower run of the path for the chains and bars B will pass between the upper beam Ss and the lower beam Si. The second return device Ra is situated downstream of the stripping station E. A leading edge of the lowermost sheet F1 of the infeed pile Pe is seized in the infeed station I by an opened gripper bar B1 owing to a gripper opening device (not represented). In such a machine, the sheets are generally processed in line with the principle called an "operation with front waste", which is to say that every sheet F is blanked in the cutting station P in such a way that part of the whole of its front or leading edge will be waste Df, which is then to be separated from the sheet. However, the separation of the front waste Df within the stripper station E is not possible, since the very leading edge or front waste is and will have to remain held by the gripper bar B in order to enable the sheet F to be transferred to the delivery station R.

Generally, such a machine is not used individually, but is part of a line of various machines with a length frequently involving space problems on account of its encumbrance, the means to be used for removing the front waste Df from the gripper bar B and carrying it out of the machine have, up to now, been arranged above the delivery station R in the area where the gripper bar B returns in a downstream direction. To this aim, the machine is to equipped in that area with an opening device of the gripper bar B and a device which will push the front waste Df out of the gripper bar B, a carrier belt Tr which collects the dropped waste Df and carries it out of the machine toward the side opposite the side at which the operator is situated.

Generally, the carrier belt Tr is driven by an electric motor which differs from the main motor, since nothing requires full synchronization of its movement with the one of the other items built into the various operating stations, such as P, E and R described above. This, though, is not the case regarding the opening device of the gripper B, which device is foreseen in the area where the front waste Df is to be removed from the gripper bar B. Such an opening device of the gripper bar B comprises at least a component shiftable between a first position in which it is located outside the space attributed to the passage of the gripper bar B and a second position which, with the gripper bar B at rest, is to be occupied inside of said passage in order to act on one of the components of the gripper bar B so as to open them. Conspicuously, such an opening device of the gripper bar B is to be perfectly synchronized with the successive alternate moves of the chain pairs C carrying the gripper bar B and, hence, the sheet F from one processing station to the other. Up to now, such a synchronizing effect is obtained by having the opening device of the gripper bar B driven directly by the main motor of the machine, for example a motor which is to ensure the drive of the lower movable beam Si by means of a drive worm and an assembly of connecting rods and crankshafts K, as well as the drive pulley of the chain pair C to be added to the entrance end of the return device Rm. To this aim, a chain G is to connect, for instance, a drive pulley of the gripper opening device to another situated in the inlet return device Rm, which chain is illustrated in dash lines in FIG. 1 and is usually located on a side of the machine opposite the side on which the operator is positioned. As can be gathered from FIG. 1, the chain G is to extend over a large distance, which is still to be lengthened by the fact that its track is not even, since it has both a horizontal section and a vertical section so that both the accessibility and visibility of the various operating stations will not be interfered with. However, on account of the present exacting marketing requirements, which demand an increasingly high production speed, serious operating problems might be incurred by a chain of a particular length. In fact, the linear travelling speed of the chain can be very high, it the opening control of the gripper bar B is to be achieved. Conspicuously, a chain operated in such a condition is likely to cause trouble, due to breakage of the components, noise, vibrations, and other problems with long chains. Additional attention is to be drawn to the fact that it is most inappropriate having to use a chain of such a length acting jointly with numerous items, as well as with guiding pulleys for achieving the operation, such as opening the gripper B, which opening action is finally disproportionate with regard to the whole of the machine with the means put to operation for its achievement.

In addition, placing the belt carrier Tr in the upper part of the delivery station R prevents easy access to and sufficient visibility of this station, especially on the side opposite the operator, i.e., the rear or lower areas of the outlet end of the carrier belt Tr, where sliding rails are generally located for guiding the front waste Df toward the waste collector D at the bottom of the stripper station E. Lacking visibility and accessibility, as well as insufficient space, will be particularly undesirable if the delivery station R insures the joint operation of the so-called blank separation by means of two movable frames, of which one is situated underneath and one above the chain pairs C. In addition, in machines with relatively simplified delivery stations R and for which accessibility and visibility above the chain pair C is not a real requirement, the removal of the front waste Df in that very area will cause the machine to be considerably lengthened for the accomplishment of an operation which, as already stated, is nonetheless of secondary importance. The same conclusion will result also with a machine comprising only two operating stations, for example an infeed station I and a cutting or processing station P provided with the press. In such a case, it will be obvious in comparison with the case illustrated in FIG. 1, that sufficient space is to be made available between the upper beam Ss of the press and the downstream return device Ra of the chain pair C exclusively for the purpose of achieving the removal of the front waste Df.

The above considerations according to which the cutting station can be combined either only with the delivery station, and of course also with the infeed station, or with a stripping station E and the delivery station R show, moreover, that the far-reaching modifications of the engineering are to be envisioned for determining the individual adaptation of the position of the carrier belt Tr and of other components destined to insure the removal of the front waste Df.

SUMMARY OF THE INVENTION

The object of the present invention is to build a machine in which the means required to insure the removal of the front waste will be arranged and designed in such a way that no means for transmitting the motion by chains or similar other long distances will be needed; that the visibility and accessibility of the different processing stations of the machine will not be hindered; that the machine's lengthwise space requirements will not be lengthened by the presence of the means for removing the front waste; that the fitting of the blanks separating frame will be facilitated in the delivery station; and that the means will not have to be shifted away, regardless of the number of processing stations.

To accomplish these goals, the present invention is directed to an improvement in a package producing machine which is designed to process sheets of material into blanks for forming packages, said machine having at least an infeed station, a press station for cutting, creasing and/or embossing, which press station includes an upper fixed beam and a lower, movable beam, conveyor means including a pair of closed-loop chains provided with gripper bars mounted in the machine to carry a sheet from one processing station to another on a lower run of the belt and removal means for removing the front waste from the sheet situated on an upper return run of the pair of chains. The improvements are that the removal means is situated above the upper beam of the press.

Other advantages and features of the invention will be readily apparent from the following description of the preferred embodiments, the drawings and claims.

DESCRIPTION OF THE PREFERRED EMBODIMENTS

Figure 2:
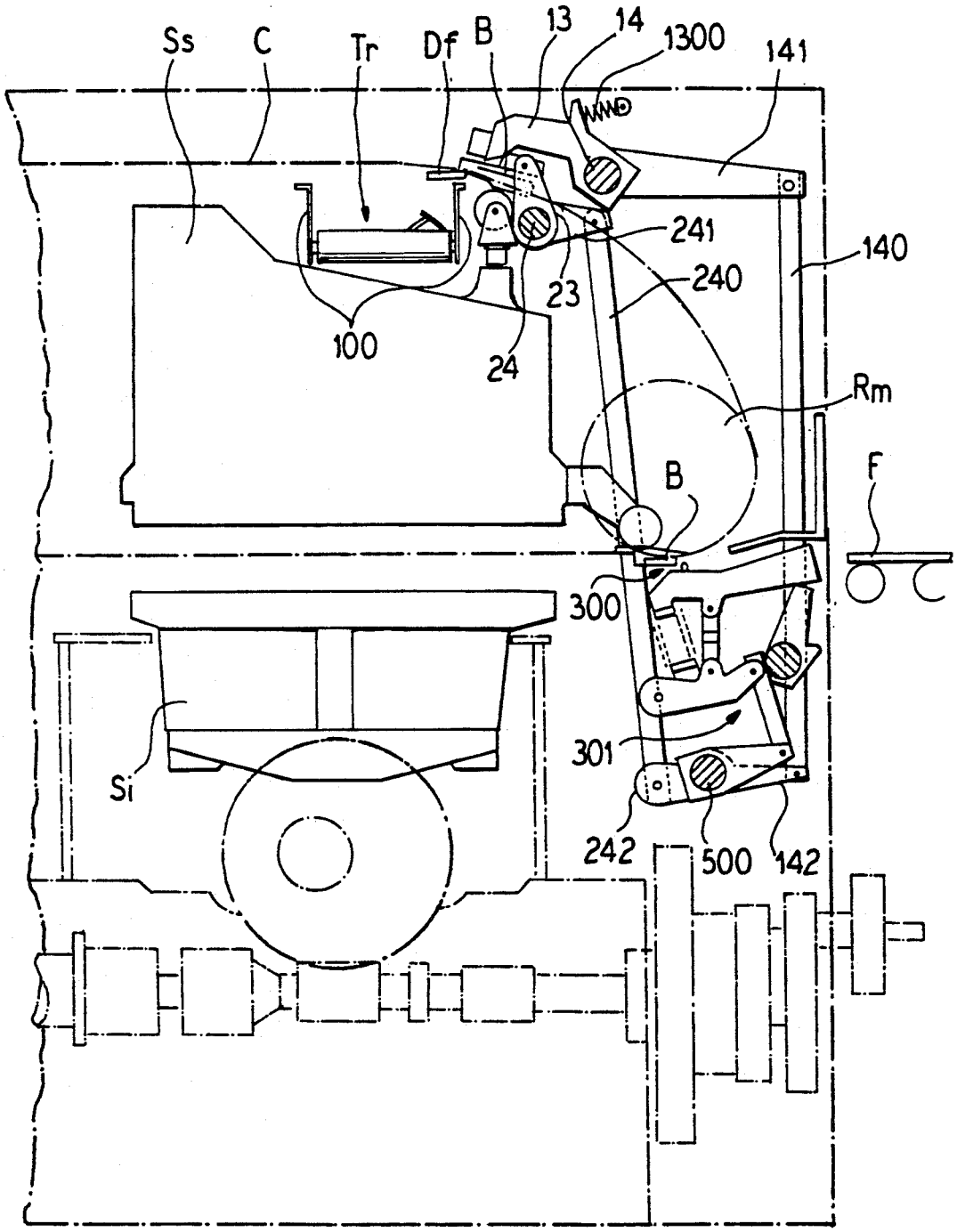
FIG. 2 is a partial cross sectional view of a machine having the improvements of the present invention.

The principles of the present invention are particularly useful when incorporated in removal means for removing the front waste from the sheet, which is illustrated in FIG. 2 and is situated above an upper beam or platen Ss of the press.

Figure 1:
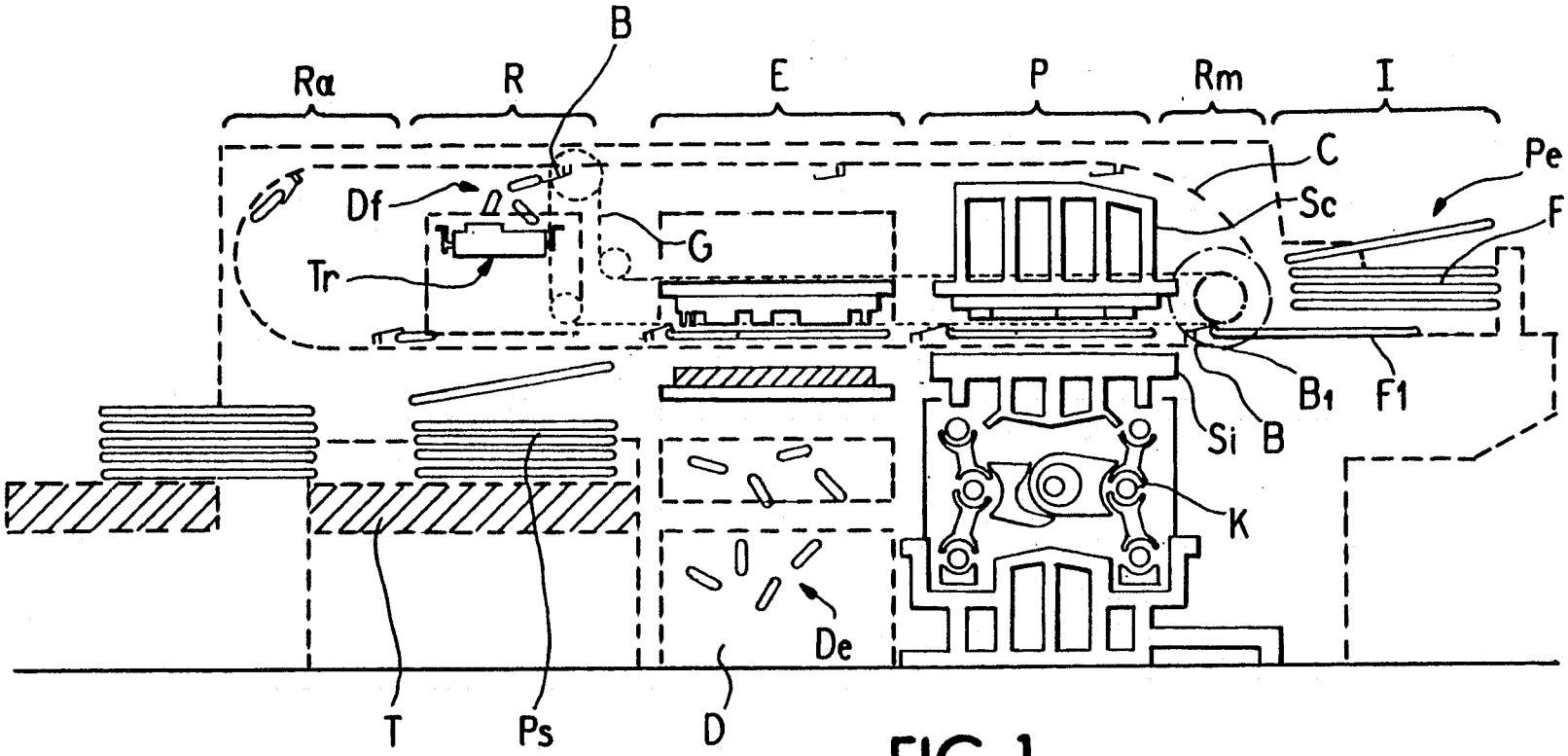
FIG. 1 (PRIOR ART)
FIG. 1 is a schematic side view of a machine of the prior art.

The cutting or press station having the fixed upper platen Ss and the lower movable platen Si, as well as part of the infeed for the blanks F is shown in FIG. 2. It should be noted that these illustrations are those taken from the operator's side, whereas many of the interconnecting drive chains are located on the opposite side to the operator's side. As illustrated, the improvement illustrated in FIG. 2 is substantially different than that of the device of FIG. 1, essentially in the fact that the removal means or assembly destined to remove the front waste Df from a gripper B and from the machine is disposed above the fixed upper beam or platen Ss of the press station. The considerations for this front waste removal device being arranged above the upper platen eliminates many of the drawbacks mentioned above concerning the prior art machines. In fact, if one refers to FIG. 2, it is clear that the upper part of the delivery station R of the device of FIG. 1 become completely free both for accessibility and visibility of the latter because of the fact that the removal means for removing waste is no longer positioned thereabove. In addition, the delivery station will have sufficient space for easy fitting of the blank separating frames wherever they are required. In the event of a simplified delivery station R being used, there is a possibility to arrange the downstream return device Ra of the chain pair C in the upper part of the delivery station so that a shortened overall length for the machine can be accomplished. Another advantage is that in the event the machine is being used without a stripping station E, there is a possibility to arrange the downstream return part Ra very close to the upper beam Ss of the platen press in such a way as to limit the lengthwise size of the machine. Another advantage is the length of the drive means for transmitting the motion between the main drive system of the machine can consist of a large oil-filled housing occupying the whole rear side of the press as opposed to the operator's side and the drive means for the removal means is, thus, considerably reduced in size with regard to the prior art drive means. In reality, as will be seen hereafter, the long chain used up to now will be replaced by a bar or lever arrangement, which is shaped as a pull-rod.

Consequently, even if the area to be chosen for the removal of the front waste Df might be surprising, the solution will, nonetheless, bring about numerous advantages, for nobody ha hitherto had the idea to conceive the removal in such a reduced space situated between the return track of the chain pair C and the upper beam Ss of the press. It is understood that it will be obviously necessary to slightly increase the height of the return area of the pair C, however this does not result in any serious consequences.

In FIG. 2, the chain pair C is illustrated in a state of rest with the various operations of the processing press being carried out and a front waste Df being removed from the gripper bar B in order to drop on a carrier belt Tr travelling between two lateral walls 100 which act as a horizontal trough, guiding the waste Df, which is to be removed toward the side opposite the operator's side. As can be seen in FIG. 2, the front waste Df is removed from the grippers of the bar B in the area where the chains C begin to descend toward the entrance pulley Rm. This area has been chosen since it allows to make the best possible use of the space available for an appropriate arrangement of the components destined to remove the front waste.

Figure 3:
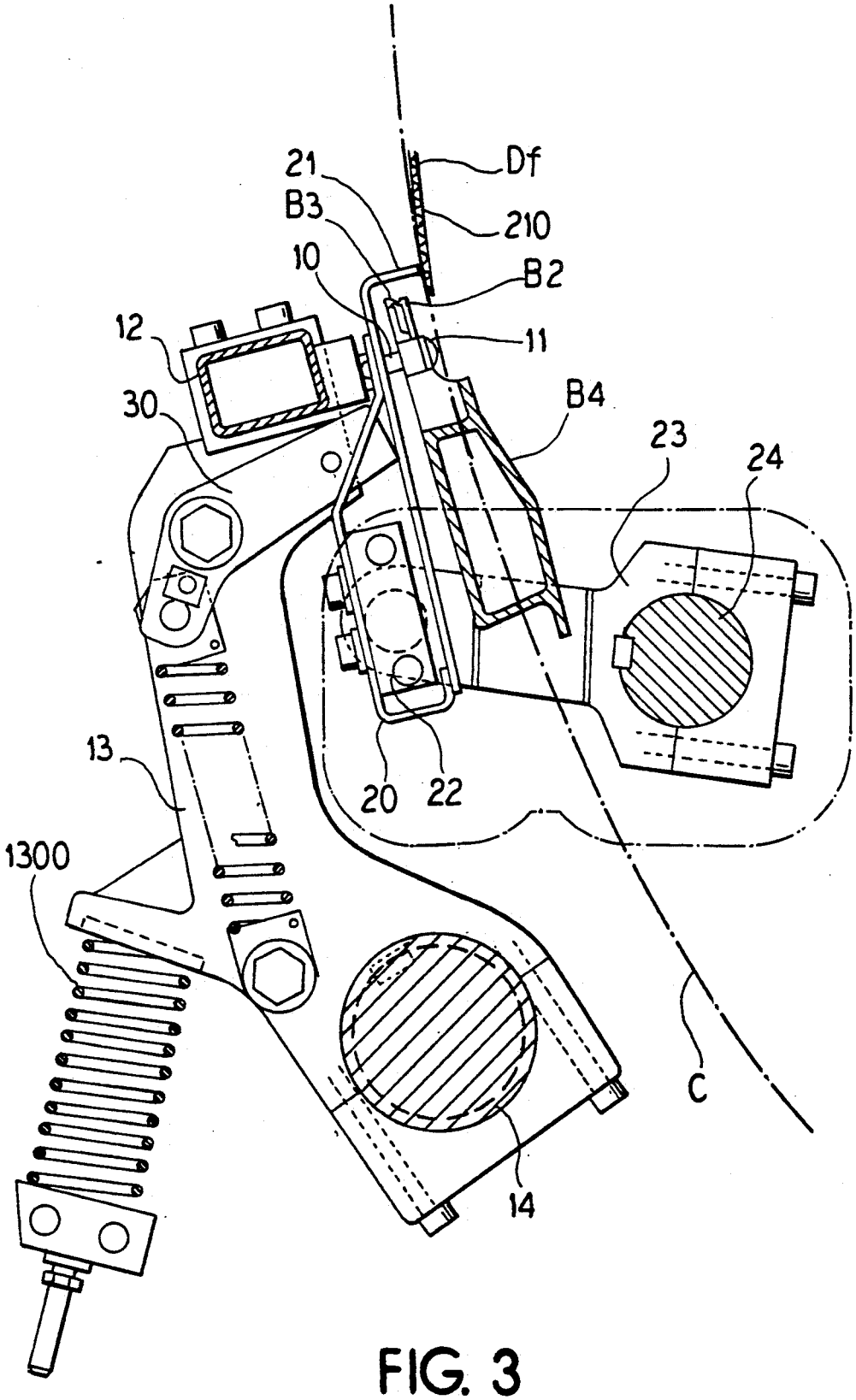
FIG. 3 is a detailed cross sectional view of a portion of the machine opening the gripper bars to remove the front waste.

For removing the waste Df from the gripper bar B, the first thing to be done is to open each gripper of the bar. Generally, such a gripper bar B consists of a hollow profiled piece B4 (FIG. 3) on which is mounted several crosswise offset grippers, each including a flat spring B2 and a fixed gripper counterpart B3. The gripper are opened by pushing the spring B2 down by means of a pusher 10 having the shape of a punch and which has an end provided with a tip 11 of a sound absorbing and wear reducing plastic material, such as polyurethane rubber which was vulcanized on the tip 11. Each pusher 10 is to pass through a corresponding aperture in the gripper counterpart B3 and is fitted on a first profile piece or bar 12, which is arranged to extend parallel to the gripper bar B. Every lengthwise end of the profiled piece 12 is fitted on a first end of a fist tilting lever 13 that is mounted fixedly on a shaft 14 which itself is mounted for rotation in the machine frame so as to be able to be driven or pivoted around the axis of the shaft 14.

Figure 4:
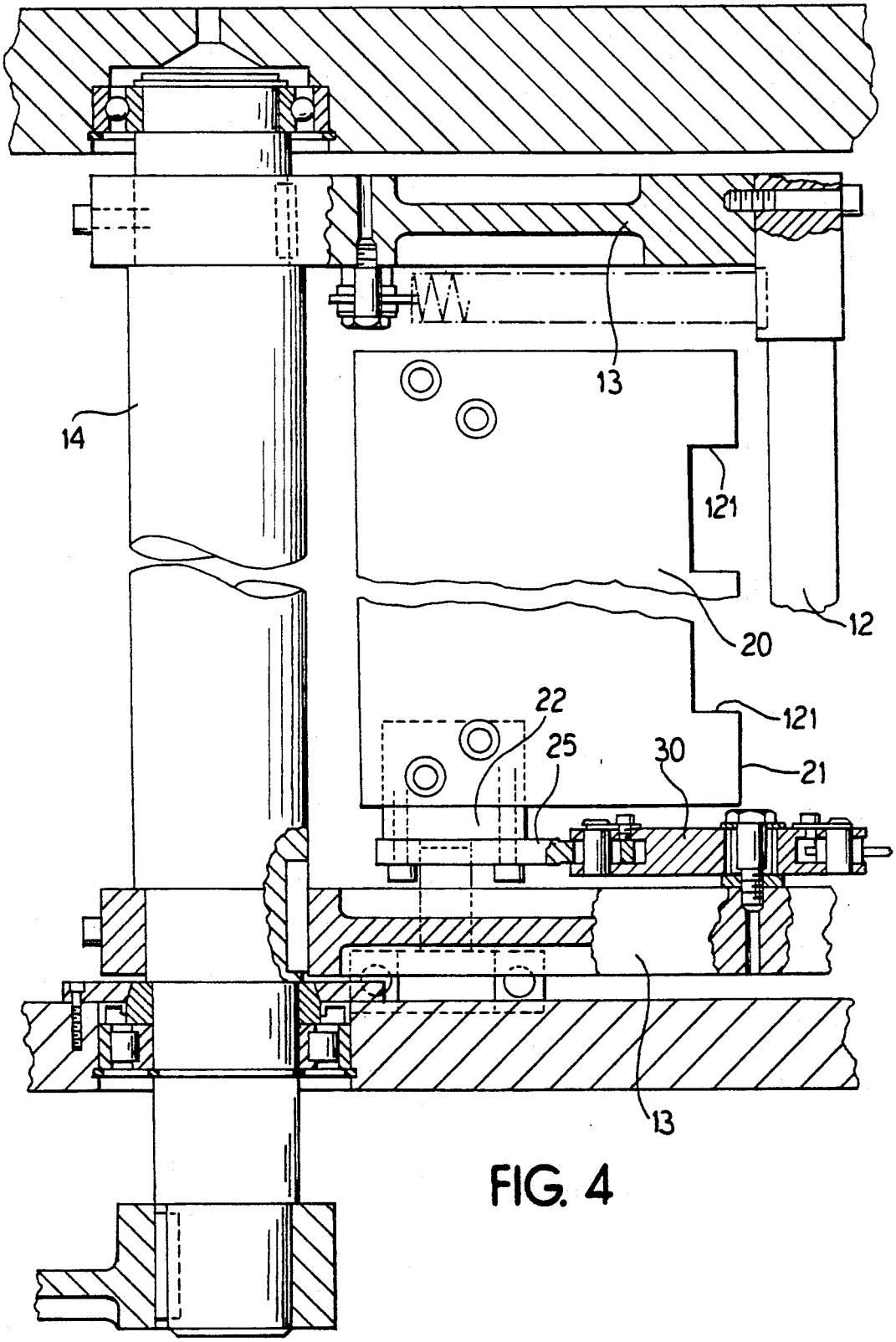
FIG. 4 is a partial top plan view of the arrangement of FIG. 2, with portions broken away for purposes of illustration.

The device which is destined to remove the front waste Df from the gripper B2 and the gripper counterparts B3 consist of a second profiled piece or member 20 on which one side, viewed sidewise, is provided with an extension 21 bent downward in the form of fingers. As illustrated in FIG. 4, the extension 21 has portions 121 removed to form individual fingers 21 and, therefore, the bent-down portion or fingers 21 resemble a rake having spaces between which the grippers B2 and gripper counterparts B3 can be positioned. An inside of each of the second profiled pieces 20, which is opposite the fingers 21, in engaged on a rotary piece 22, which is mounted for pivotable movement on a first end of a second tilting lever 23, which is mounted for pivoting with a shaft 24. In order to enable the rake 21 to act up to its role, i.e., to push the waste Df outside of the space between the grippers B2 and the gripper counterparts B3, the free end 210 of the rake (FIG. 3), which comes into contact with the waste Df, is to be impelled with a rotary motion. To achieve this motion, it appears appropriate to have the tilting of the first lever 13 be joined by the rotation of the second profiled piece 20 with regard to the second lever 23. To this aim, every piece 22 of the second profiled piece 20 is linked by means of a connecting rod 30 to the first tilting lever 13. Owing to the appropriate dimensions of the various levers 13, 23 and the connecting rods 30, a well as to the positioning of the various shafts 14, 24, there is a possibility to obtain the desired shift of the end 210 of the rake 21. Two tightened springs 1300, each one having an end fitted to the frame of the machine and with the other end connected to the tilting levers 13, have a tendency to put the two levers 13 back into position, such as to allow the rake 21 and the pusher 10 to be positioned outside and withdrawn from the track of the gripper bar B.

FIG. 2 shows that the drive shaft 500, which is situated in the lower area of the platen press will insure the rotation of the drive shafts 14 and 24 by means of a lever arrangement which includes a pull rod 140 connected between lever arms 141 and 142 and a pull rod 240 connected between the lever arms 241 and 242. These pull rods and arms are all located within an oil filled housing, as mentioned above.

The shaft 500 also controls the gripper opening device 300 in the infeed station by means of a lever, such as 301. The opening device 300 resembles the one described above that is used for stripping the front waste.

Such an arrangement for the front waste removing means is, of course, also possible in a press with a movable upper beam and a fixed lower beam. In such a case, the movable means will fit immediately on the lateral machine frame.

Although various minor modifications may be suggested by those versed in the art, it should be understood that we wish to embody within the scope of the patent granted hereon all such modifications as reasonably and properly come within the scope of our contribution to the art.

We claim:

1. A machine for producing blanks for packages from sheets of material, said machine including a row an infeed station, a press station for cutting creasing and/or embossing a sheet to form a die cut sheet, a stripping station for stripping waste from the die cut sheet to produce a stripped sheet and a delivery station to deliver the stripped sheet form the machine, said press station including an upper fixed beam and a lower movable beam, said upper beam having a first side facing the infeed station, conveyor means including a pair of closed-loop chains provided with gripper bars arranged to carry a sheet from the infeed station through the press station, the stripping station to the delivery station with the chains moving between the upper and lower beams of the press station and removal means for removing a front waste from the sheet situated on an upper return run of the pair of chains above the upper beam of the press station and adjacent the first side of the upper beam, said removal means including a rake-shaped component pivotably movable between a first position above and outside of the upper return run of the gripper bars and a second position in which said rake-shaped component will be in contact with a front waste in order to push said front waste out of the area between a gripper and a gripper counterpart of the gripper bar, said rake-shaped component having an end with teeth being in contact with the front waste when said component is in the second position, said end extending in a plane essentially transverse to the direction of movement of the pair of chains on the upper return run.

2. A machine according to claim 1, wherein the removal means includes a carrier belt extending transverse to the direction of movement of the chains through the machine and exiting the machine on a side opposite the operator's side, said press station being provided with an oil-filled housing on the side opposite the operator's side, said carrier belt fitted on the upper beam and removing the front waste in the area situated above the oil-filled housing.

3. A machine according to claim 2, wherein the removal means includes means for opening the gripper bars and consists of at least one pusher movable between a first position in which it will be outside of the track followed by the gripper bars and a second position in which it will open a gripper, each of the pushers having the shape of a punch and being provided on an end with a tip of a material to reduce noise and wear during its contact with the gripper.

4. A machine according to claim 3, wherein the pusher is fitted on a first end of a first pivotable lever and the rake is mounted on a first end of a second pivotable lever, the other end of each first and second lever being connected to a respective rotary shaft, said rotary shafts being rotated by a main drive shaft and an assembly of levers and pull rods, said assembly and main drive shaft being within an oil-filled housing situated in the press station on a side opposite the operator's side, said main drive shaft being situated in a lower area of said press station and also opening the gripper bars in the infeed station.

5. A machine according to claim 4, wherein the rake is fitted on a second profiled piece mounted for free lengthwise pivoting on the second lever, said pushers being fitted on a first profiled piece to be able to retract, said first profiled piece being mounted on the first lever, at least one connecting rod being arranged between a first lever of the pushers and the second profiled piece of the rake to insure joint movement of the first and second levers for the purpose of having the end of the rake move in sequence with the pusher.

6. A machine according to claim 2, wherein the upper beam has a recess adjacent the first side for receiving the carrier belt.

7. A machine according to claim 1, wherein the means for removing includes a system for gripper bars and includes at least one pusher tilting between a first position in which said pusher will be outside of the upper return run followed by the gripper bar and a second position in which said pusher will open a gripper of the gripper bar, said pusher having a shape of a punch and being provided on an end with a tip of material which will reduce noise and wear during the contact of the tip with the gripper.

8. A machine according to claim 1, wherein the removal means includes a pusher being mounted on an end of a lever mounted for rotation with a first shaft, said rake-shaped component being mounted on a second lever in turn mounted on a second shaft for rotation, means for rotating said shafts including lever arms and pull rods extending from a main drive shaft, said main drive shaft also operating an opening device for the gripper bars at the infeed station.

9. A machine according to claim 1, wherein the rake-shaped component is mounted on a second profiled piece which, in turn, is mounted to pivot on a part of second lateral tilting levers, said pushers being mounted on a first profiled member, itself mounted on first levers, at least one connecting rod being arranged between the first tilting lever and the second profiled piece so as to insure joint tilting of the first and second levers with the purpose of having the end of the rake-shaped component move in a desired path as the gripers are opened.

10. A machine according to claim 1, wherein the upper beam has a recess on an upper surface adjacent the first side and said removal means includes a carrier belt extending transverse to said chains and being mounted on the upper beam in said recess.

* * * * *